United States Patent [19]

Miedaner et al.

[11] Patent Number: 4,468,906

[45] Date of Patent: Sep. 4, 1984

[54] BLOCKS OR BRICKS FOR THE CONSTRUCTION OF A TWO-SHELL TILE STOVE

[76] Inventors: Horst Miedaner, Guetratweg 10; Herbert Spirk, Kühbergstr. 31, both of A-5020 Salzburg, Austria

[21] Appl. No.: 306,613

[22] PCT Filed: Dec. 30, 1980

[86] PCT No.: PCT/AT80/00038

§ 371 Date: Sep. 17, 1981

§ 102(e) Date: Sep. 17, 1981

[87] PCT Pub. No.: WO81/02193

PCT Pub. Date: Aug. 6, 1981

[51] Int. Cl.[3] ..... E04B 1/00; F23M 5/02

[52] U.S. Cl. ..... 52/279; 110/338

[58] Field of Search ..... 52/610, 279, 275; 110/336, 338

[56] References Cited

U.S. PATENT DOCUMENTS 1,461,851 7/1923 Kagermeier ..... 52/279
1,798,734 3/1931 Heath ..... 52/610

FOREIGN PATENT DOCUMENTS 0033485 2/1983 European Pat. Off. .
356004 7/1922 Fed. Rep. of Germany .
916579 7/1949 Fed. Rep. of Germany .
920986 7/1949 Fed. Rep. of Germany .
419515 3/1967 Switzerland .

OTHER PUBLICATIONS

Luegers Lexikon der Gesamten Technik, g 199, 1928.

*Primary Examiner*—John E. Murtach
*Assistant Examiner*—Kathryn L. Ford
*Attorney, Agent, or Firm*—Karl F. Ross; Herbert Dubno

[57] ABSTRACT

The dimensions of the blocks or bricks are, first, derived from the side lengths a, b of the tiles and, second, from the thickness d of the corner tiles, whereby an amount (a/2)−d, or (b/2)−d is obtained for the wall thickness of the blocks. The two-shell structure as well as the usual staggered arrangement by half the tile length provides a sequence of blocks of the following lengths: (a/2)−d, a/2, a−d, a, (3a/2)−d, 3a/2, 2a−d, 2a, etc. A further sequence of blocks of the following heights is obtained: (b/2)−d, b/2, b−d, b, (3b/2)−d, 3b/2, 2b−d, 2b, etc. Further sequences in respect of height and length are obtained from the two basic sequences, each smallest member being a member of a basic sequence. In a preferred embodiment, the tiles have a square visible face and the thickness a/4. Hence, the blocks have the same wall thickness and the length and heights a/4, a/2, 3a/4, a, 5a/4, 3a/2, 7a/4, 2a, etc.

4 Claims, 25 Drawing Figures

2'''
b/2 - d

2''
b/2

2'
b-d 2
b
a b/2 - d
a/2 - d b/2
a/2 b-d
a-d b
a

BLOCKS OR BRICKS FOR THE CONSTRUCTION OF A TWO-SHELL TILE STOVE

CROSS REFERENCE TO RELATED APPLICATIONS

This application is a national phase application of PCT/AT80/00005 filed 30 Dec. 1980 and based upon Austrian application AT/80/00038 filed 31 Jan. 1980.

FIELD OF THE INVENTION

This invention relates to blocks or bricks for the construction of a two-shell tile stove having an inner shell of refractory blocks or bricks and an outer shell comprising wall tiles of the thickness d, the length a and the height b, and corner tiles having the same thickness d and the same height b, one leg having the external length a and the second leg having the external length a/2 or 3*a*/2, b being preferably equal to a.

BACKGROUND OF THE INVENTION

Tile stoves, which are generally made by stove fitters, consist of ceramic tiles with ribs arranged on their rear sides and running parallel to their edges. These ribs are adapted to link the individual tiles to one another by means of connecting clamps or the like, and the joints between the tiles are closed by means of a refractory material. The internal structure, the flue gas vents, are also made by refractory blocks, which have to be processed to have the required shape. The construction of a tile stove requires hard work, skill in the art as well as great technical skill. In order to facilitate such work, it has already been tried to construct the tile stove with two shells. In such case, the internal shell and structure are made of refractory blocks, and then the outer surface is covered by tiles, either as individual tiles or as slabs consisting of tiles. This work, too, should be done by a person skilled in the art even in view of the fact that the work has been substantially facilitated because of the external shell of tiles.

OBJECT OF THE INVENTION

It is, therefore, an object of this invention to provide blocks for the construction of a two-shell tile stove which ensure simple construction of tile stoves of any size. To this end, criteria shall be set by means of which the required blocks can be predetermined dependent on the number and shape of the tiles which will be needed. Hence, a construction kit can be composed for any tile stove without requiring any particular skill in the art.

SUMMARY OF THE INVENTION

This object is achieved according to the invention, by providing the blocks forming the wall with a thickness based upon the thickness d of the corner tile and with a length and height of the block based upon the length a and the height b of the visible face of the tile.

Up to the present, the internal shell and the partition walls of the flue gas vents were adapted to the length and height of the tiles by processing the individual refractory blocks in-situ. According to the invention, the thickness or wall thickness of the corner tiles is also used as a reference element and taken into consideration, when determining the dimensions of the blocks.

The following exact mathematical relations form the theoretical basis. Usual joint breadths are, therefore, contained in the afore-indicated terms. Deviations from the exact equations may be caused by inaccuracies which are due to manufacture. For this reason, one or more dimensions of the blocks may be slightly smaller than the indicated dimensions. Joints which are slightly bigger for this reason can be compensated by means of mortar.

A first embodiment provides that the wall thickness of the block corresponds to the amount (a/2)−d or (b/2)−d.

A particularly solid construction of the tile stove will be obtained by adapting the wall thickness of the block or brick to correpsond to the thickness of the tiles, d being equal to a/4, so that the internal as well as the external shell of the tile stove are selfsupporting.

Blocks according to the invention can be combined to form sequences. A first sequence results from considering the following relations of lengths between individual blocks:

(a) the lengths of the first block of the sequence corresponds to the amount (a/2)−d, (b) the difference in length between the first two blocks of the sequence corresponds to the amount d, (c) the difference in length between two blocks, each, of the sequence of even and odd place value corresponds to the amount a/2.

If the wall thickness of the block or brick corresponds to the tile thickness and if said thickness is one fourth of the tile length the afore-indicated relations are substantially simplified. The blocks then have the following lengths: a/4, a/2, 3*a*/4, a, etc., the difference always being *a*/4.

A further sequence of blocks according to the invention has the following relations of heights:

(a) the height of the first block of this sequence corresponds to the amount (b/2)−d, (b) the difference in height between the first two blocks corresponds to the amount d, (c) the difference in height between two blocks, each, of the sequence of even and odd place value corresponds to the amount b/2.

The above-mentioned simplification will also be possible if the wall thickness of the block corresponds to the tile thickness, said tile thickness being one fourth of the tile height. In such case, the blocks have the heights b/4, b/2, 3b/4, b, etc.

Various further sequences of blocks can be derived from these basic sequences. For example, the relations of lengths may also be valid for sequences whose first blocks have the heights (b/2)−d, or b/2, or b−d, or b, etc.

In a preferred embodiment, when the tiles are of square shape and their thickness is one fourth of the side of the square, the total number of blocks from all sequences is substantially decreased as equal blocks appear in different sequences.

Moreover, not each building stone of each sequence will be required for solving the problem of the present invention. In the preferred embodiment, in particular, employing square tiles having a thickness of one fourth of the side length, individual blocks of the sequence which are rarely required need not be separately made, they can be composed of two smaller blocks at least.

SPECIFIC DESCRIPTION

Figure 1:
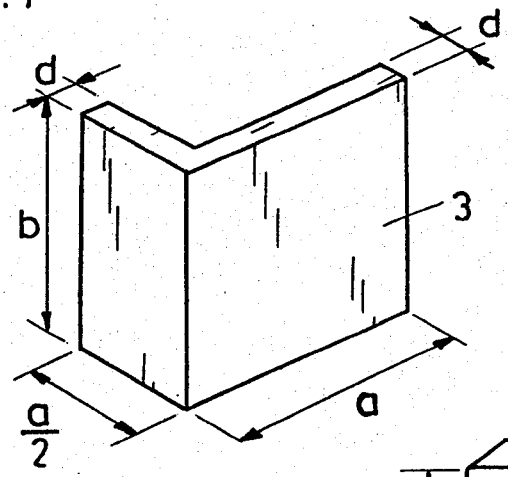
FIGS. 1 and 2 show a corner tile and a preferred embodiment of a usual tile for a better illustration of the invention.
Figure 2:
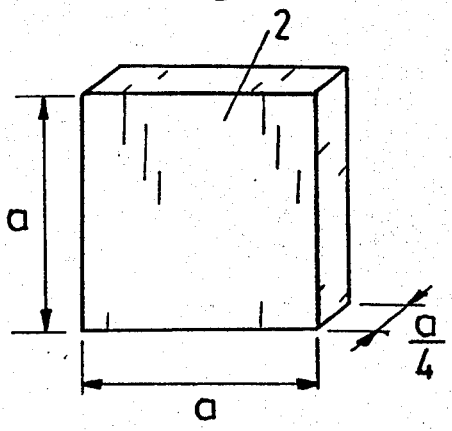

The corner tile 3 for a horizontal row of a tile stove illustrated in FIG. 1 has a wall thickness d, a height b and the external lengths of its legs are a, a/2. As illustrated in FIG. 2, the height b of stove tiles 4 is preferably equal to the length a, the wall thickness being a/4. The tiles 4 and the corner tiles 3 serve as reference elements for the dimensioning of the refractory blocks or bricks 1, 1', 1'', 1''' used for constructing the internal shell 5 of the tile stove. As illustrated in FIGS. 6 through 9, the length of a block 1 corresponds to the length a of a tile 4 and of one leg of a corner tile 3. This means that over the length of a tile stove whose front part of the external face 6 consists, for example, of three tiles 4 and two corner tiles 3 of the length a (FIGS. 6, 7), the length of the front part of the internal shell 5 is by twice the wall thickness d of the corner tile smaller than the length of said part of the external shell 6, said length being 4½*a*. *As the usual amount by which the rows are staggered is half the block length, half the leg of the corner tile 3 of the length a (FIG. 6, left corner FIG. 7) is overlapped by a block 1. Hence, there remains an interspace of the breadth (a/2)*—d, which is filled by a block 1' of the side part of the internal shell 5, said side part also having a wall thickness of (a/2)—d. The block 1', which overlaps again the tile 4 adjacent the corner tile 3 by the amount a/2, is shorter than the length a by the wall thickness of the corner tile 3. Its length is, therefore, a—d.

Figure 6:
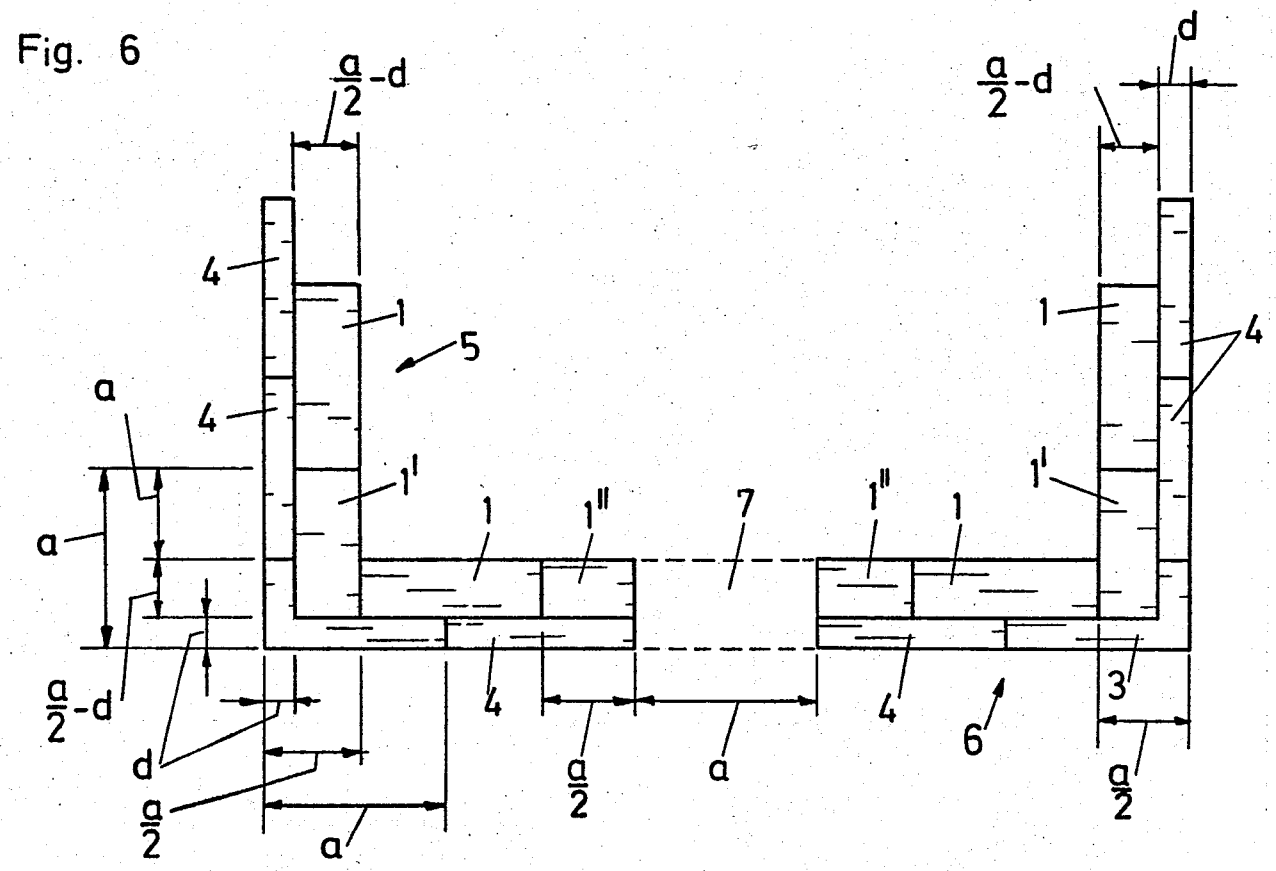
FIGS. 6 through 10 show sections of bricked up blocks for tile stoves in different embodiments.
Figure 7:
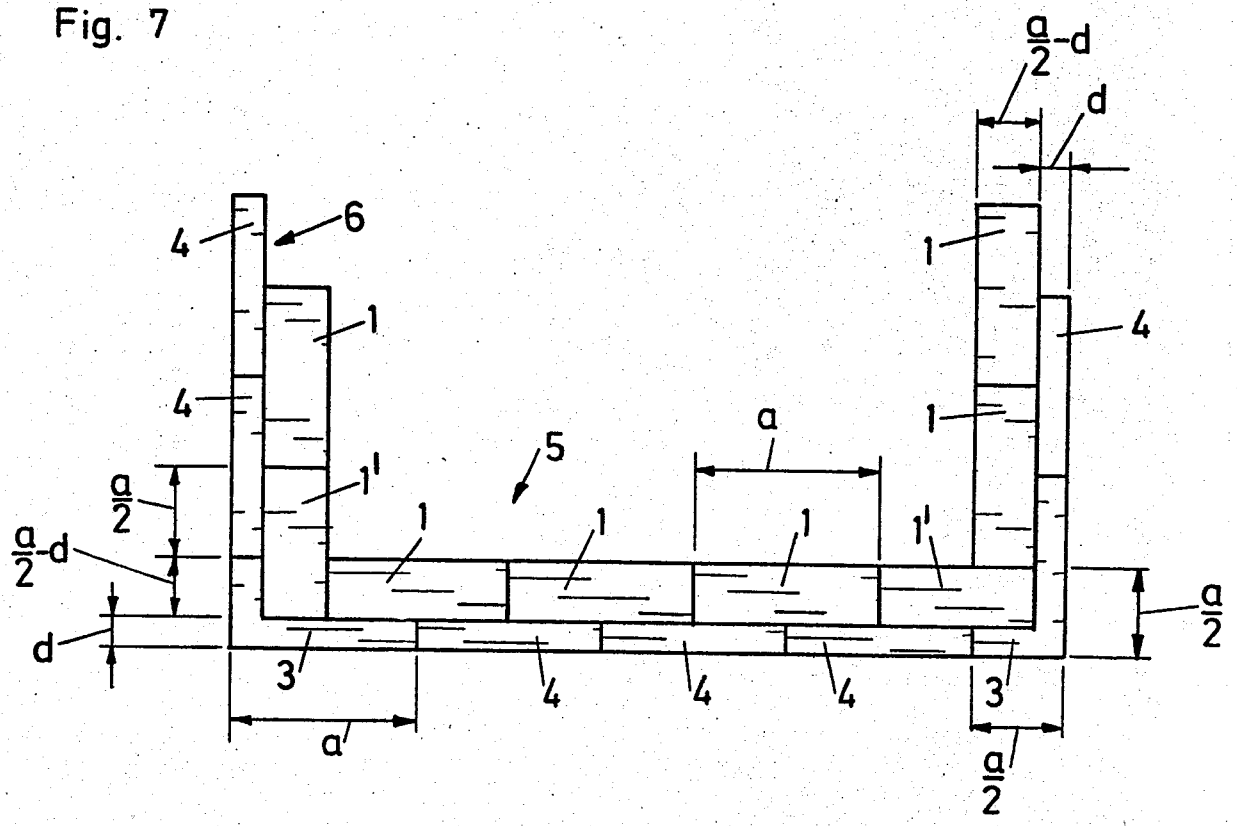

An aperture 7 for a door is provided in the horizontal row illustrated in FIG. 6. The aperture has the shape of a tile 4 and has, therefore, also the length a. Hence, laterally adjacent blocks 1'' must have the length a/2.

Figures 3A, 3B, 3C, 3D:
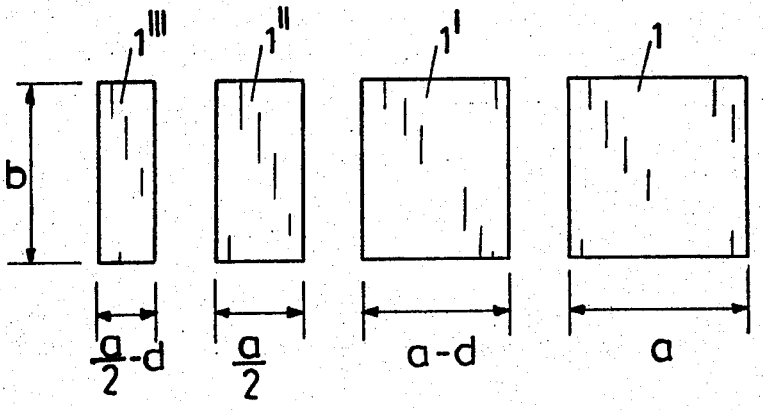
FIGS. 3 through 5 show sequences of blocks according to the invention.

The blocks or bricks 1 can, therefore, be combined to form sequences which are derived from the dimensions of the corner tiles 3. The dimension of their wall thickness corresponds to the amount (a/2)—d, their lengths are determined by the values b, a/2 (FIG. 3). The length of the smallest block 1''' of the sequence also corresponds to the amount (a/2)—d, and, has hence a square base surface. This block is used in certain cases as will be described later on. The second block 1'' of the sequence has the length a/2, the third block 1' the length a—d, the fourth block 1 the length a etc., the differences in length between two blocks being d or a/2—d. The sequence can be continued as blocks having the lengths (3a/2)—d, 3a/2, 2a etc. are also possible.

Figures 4A, 4B, 4C, 4D, 5A, 5B, 5C, 5D:
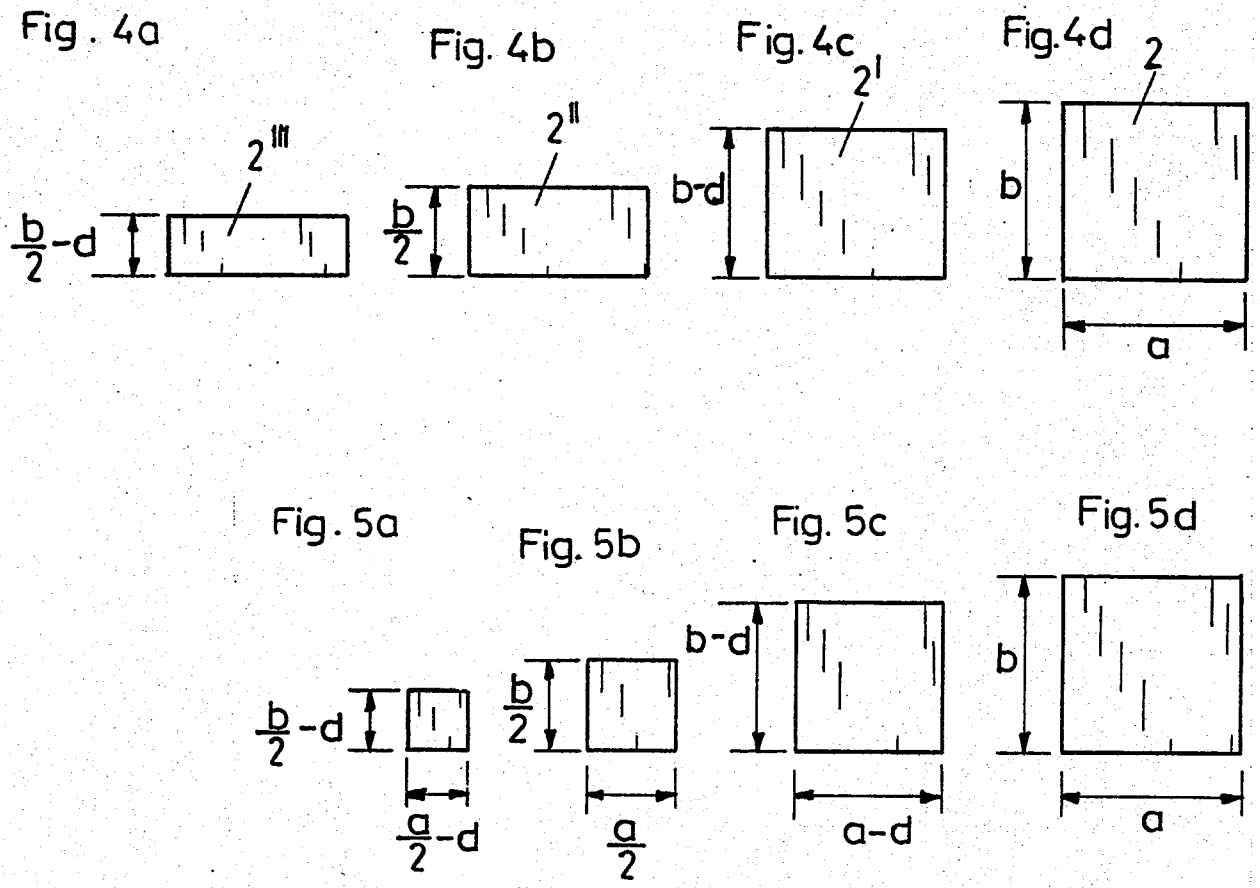

The above-indicated facts are also true for the heights of the blocks. In general, the height of a block 1 corresponds to the height b of the tile 4 and corner tile 3. The uppermost row covering a tile stove also comprises corner tiles, which have not been illustrated. In such case, the height of the blocks 2 is also derived from the thickness d of the tiles 3, 4. The blocks 2 can also be combined to form a sequence with the following heights: (b/2)—d, b/2, b—d, b, (3b/2)—d, 3b/2, 2b—d, 2b, etc. (FIG. 4). The wall thickness of the blocks 2 then corresponds to the amount (b/2)—d, their lengths corresponds preferably to the amount a. Further sequences can be formed from these basic sequences: first, sequences comprising blocks 1 of one of the above-indicated lengths (a/2)—d, a/2, a—d, a, etc., with the heights (b/2)—d, b/2,b—d, b, etc., and second, sequences comprising blocks 2 of one of the above-indicated heights (b/2)—d, b/2, b—d, b, etc. with the lengths (a/2)—d, a/2, a—d, a, etc.

A further sequence is shown in FIG. 5. The blocks illustrated in this figure have the following lengths and heights: (a/2)—d, (b/2)—d; a/2, b/2; a—d, b—d; a, b.

This blocks 1, 2 according to the invention are not only suitable for the internal shell 5. In the preferred embodiment, in particular, which employs square tiles 4 (FIG. 2) for the external shell 6 whose thickness d is one fourth of the side length the blocks can readily, without any further processing, be used for the internal walls of the tile stove.

Figure 8:
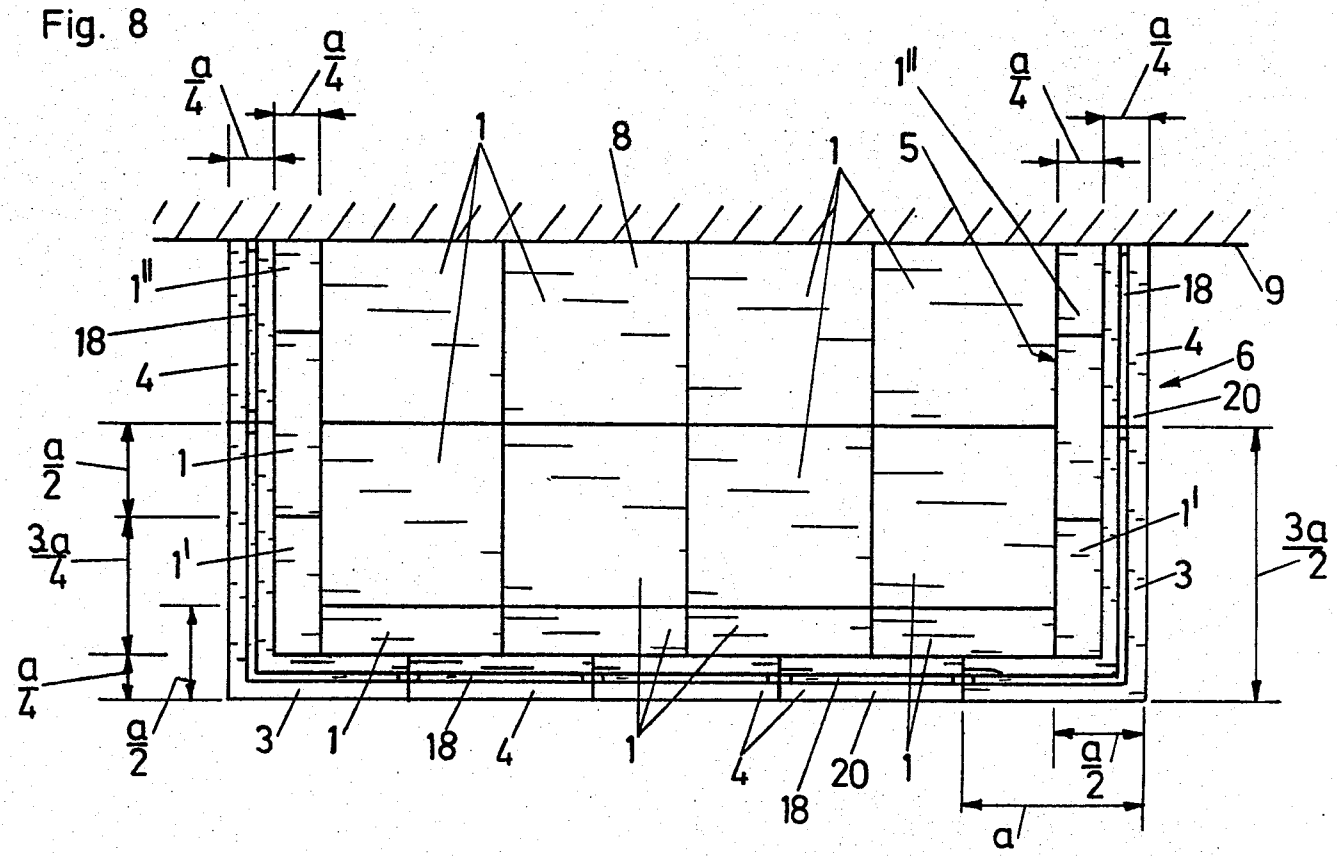

Part of a three-sided tile stove built to a wall 9 is shown in FIG. 8. In this embodiment, blocks 1 are composed to form a bottom plate 8. The length of the side part of the external shell 5 is 2½*a, the depth of the bottom plate (perpendicularly to the wall 9) is exactly 2a* as the wall thickness of the blocks (a/2)—d plus the wall thickness d of the tiles 4 corresponds to the amount a/2. The length of the front part of the external shell 6 is 5*a* so that the length of the bottom plate is exactly 4*a*, i.e. two times reduced by the amount a/2.

In FIG. 8, the wall thicknesses of the blocks 1 and of the tiles 3, 4 are equal, i.e. a/4. Corner tiles 3 are also shown, the external lengths of their legs not being a/2 but 3a/2.

Figure 9:
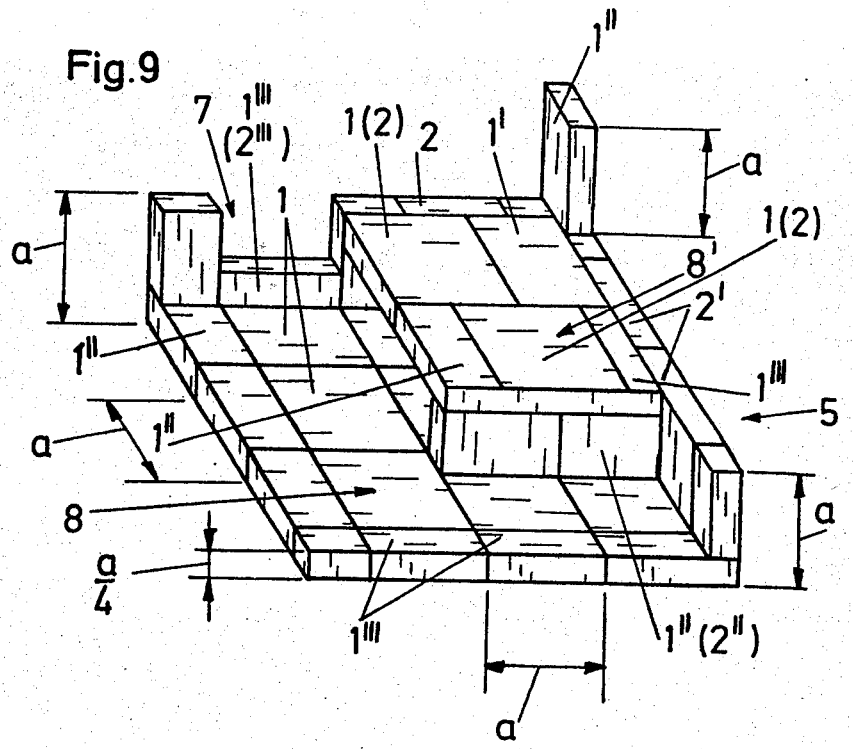

FIG. 9, which is an oblique view of parts of a tile stove without the external shell 6, illustrates particularly the advantages of the blocks according to the invention. Parts of an intermediate plate 8', which substantially forms the bottom of the fire space, have already been built. The bottom plate 8 consists of blocks 1 of the size a×a, of lateral pieces namely of lateral blocks 1'' of the size a×( a/2), of rear blocks 1''' of the size a×(a/4), all of said blocks belonging to the same sequence. In the left rear corner, a block of the size (a/2)×(a/4), which belongs to another sequence, is provided. The first, horizontal row comprises blocks 2' of the size (3a/4)×a, a rear end block of the size (3a/4)-×(a/2), blocks of the size (3a/4)×(a/2) on both sides of the aperture 7, which is, for example, provided for the door of the ash pit as well as two blocks of the size (3a/4)×(a/2) and (3a/4)×(3a/4) in the corner region. A block 1''' (2''') of the size a×(a/4) is arranged below the aperture 7. The blocks of the first horizontal row also belong to different sequences.

The intermediate plane 8' comprises blocks 1, 1', 1'' and 1''', the center support comprises a block 2'' of the size a×(a/4) and a block of the size (3a/4)×(a/2) belonging to another sequence. The second horizontal row has been indicated by a block 1'' of the size (a/2-)×a.

In the manner described in respect of the intermediate plate 8', further elements of a tile stove, such as flue gas vents, etc. can be built of blocks according to the invention in the desired arrangement without further processing as blocks of the required sizes can be taken from the available sequences.

In the preferred embodiment with square tiles of the size a×a and the thickness a/4 only few sequences of blocks are generally required, i.e. a basic sequence of the height a and the lengths a/4, a/2, 3a/4, as well as two further sequences of the same lengths and the heights a/4 and a/2. If any blocks belonging to other sequences are required they can easily be assembled with blocks belonging to the afore-indicated sequences. The blocks can be bricked up or glued in the usual manner.

In order to improve the connection between the blocks 1, 2 according to the invention, preferable, two faces 10 being in contact with adjacent blocks are provided with longitudinal center ribs 12, the two opposite faces 11 being in contact with adjacent blocks are provided with longitudinal grooves 13 corresponding to the longitudinal ribs 12. As illustrated in FIGS. 10 through 16, the longitudinal ribs 12 and longitudinal grooves 13 can be arranged on adjacent faces of the block but also on opposite faces thereof.

Lateral grooves 16, 17 arranged on the first side face 14 of the block 1, which is directed towards the inside of the stove, substantially facilitate the construction of the tile stove.

Figure 11:
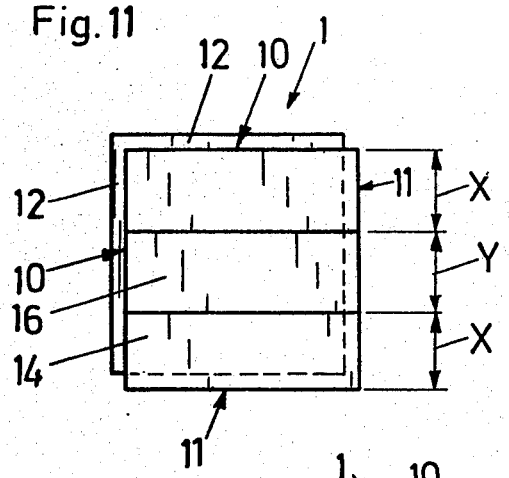
FIGS. 11 through 16 show different embodiments of the front faces and side faces of the construction.
Figure 12:
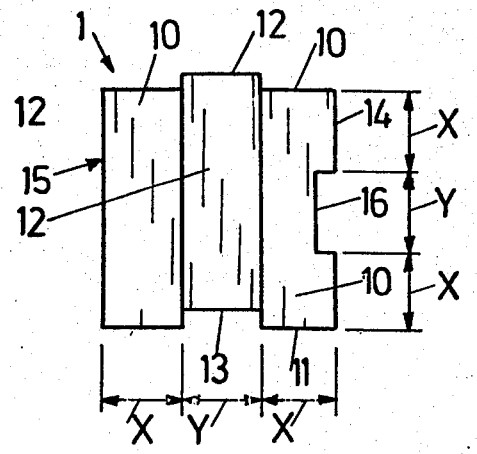

FIGS. 11 and 12 show a first embodiment with one first lateral groove 16, the marginal distances x of said lateral groove 16 corresponding to those of the longitudinal grooves 13 in the face 11. The first lateral groove 16 has a breadth y, which is equal to the breadth of the longitudinal groove 13 and, hence, of the longitudinal rib 12 so that the block illustrated in FIGS. 11 and 12 is substantially a cube. It corresponds to the smallest block of the sequence according to FIG. 5. For building a corner, the block 1 is turned from the illustrated position by 90° so that the lateral groove 16 runs vertically. The longitudinal rib 12 of the face 10 can, hence, be inserted into the lateral groove 16.

Figure 13:
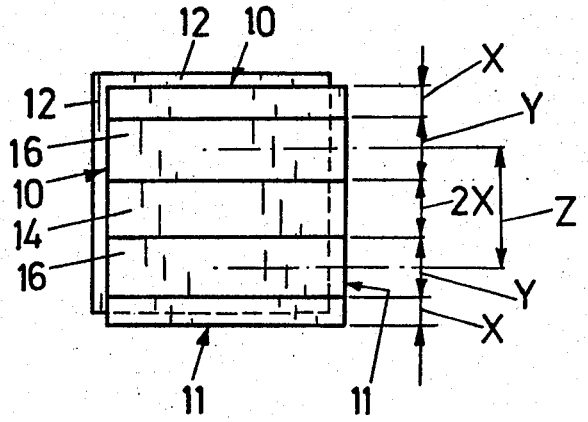
Figure 14:
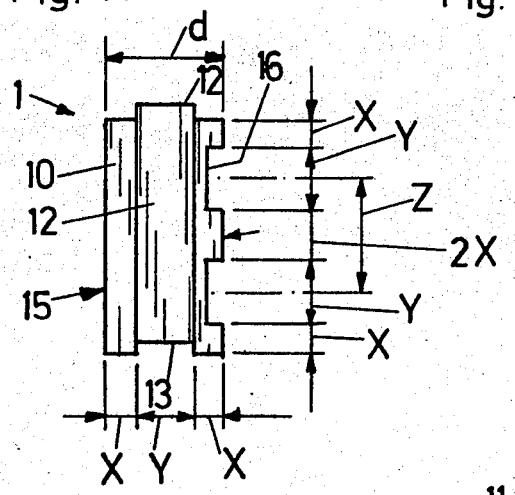

The embodiment illustrated in FIGS. 13 and 14 shows a block with two first lateral grooves 16 in the first side face 14, said two lateral grooves 16 having marginal distances x, which again correspond to the marginal distance of the longitudinal groove 13, and being spaced from each other by the distance 2x. The breadth y of the first lateral groove 16 corresponds again to the breadth of the longitudinal groove 13. As a result, the center distance z of the two lateral grooves 16 corresponds to the wall thickness d, and said wall thickness d corresponds to half the height of the block 1.

Figure 16:
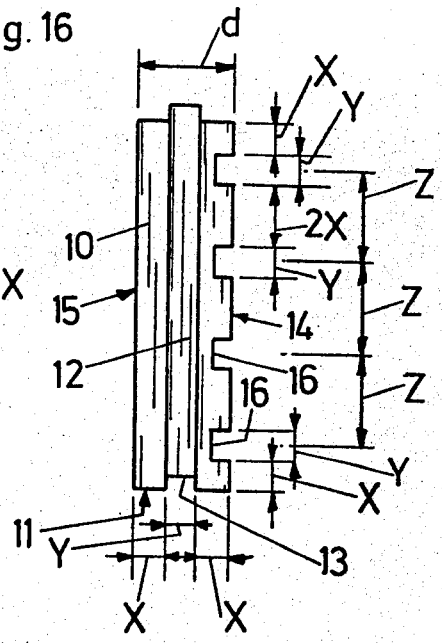
Figure 15:
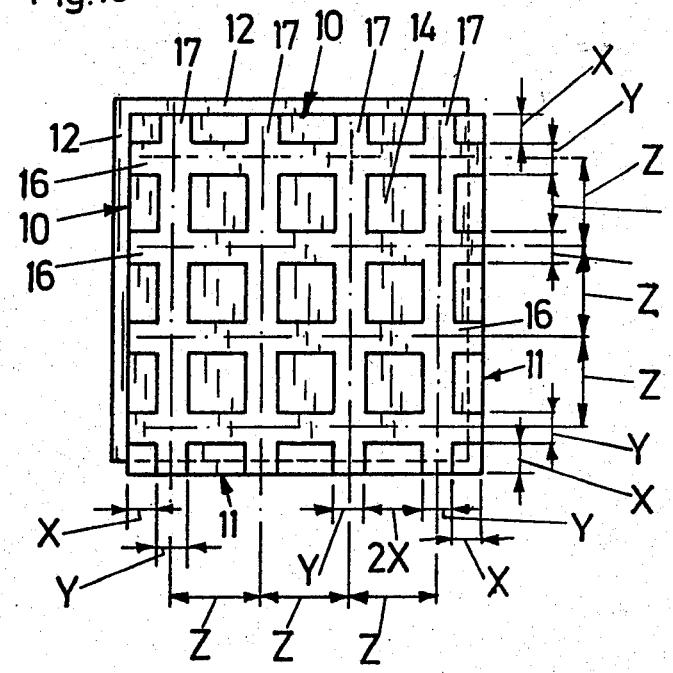

FIGS. 15 and 16 show a preferred embodiment. Four first lateral grooves 16 are arranged on the first side faces 14, said four lateral grooves having the breadth, which is equal to the breadth of the longitudinal groove 13. The center distance z of two lateral grooves 16, each, is equal to the wall thickness d, and the marginal distance x is equal to the marginal distance of the longitudinal groove 13. Moreover, four second lateral grooves 17 are provided which intersect said first lateral grooves 16 at a right angle and for which the same relations are true. Elevations remain between the lateral grooves 16, 17, the surface of said elevations having the size x multiplied by x in the corner region, the size x multiplied by 2x in the residual marginal region and the size 2x multiplied by 2x in the center region.

Figure 10:
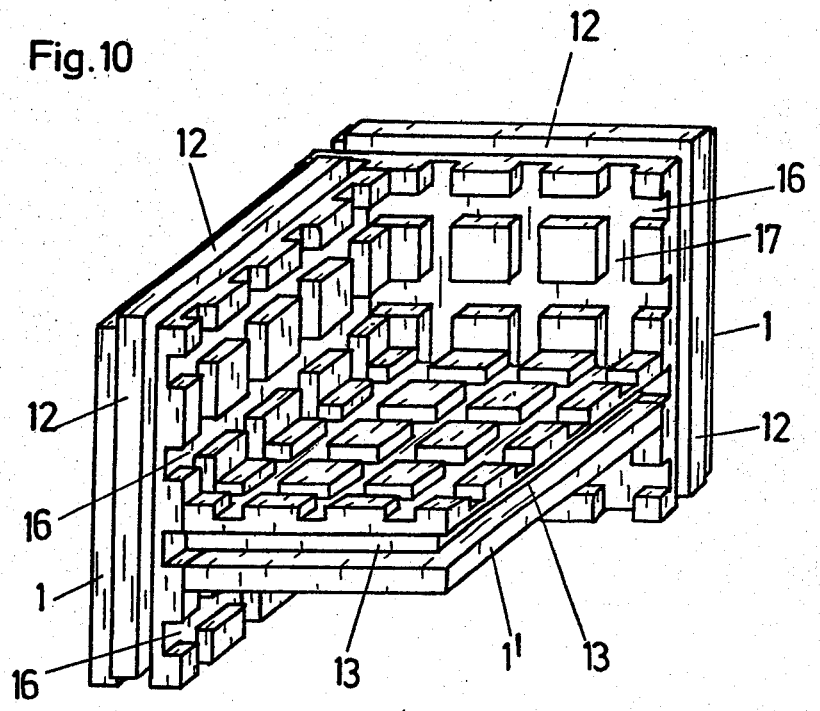

Because of its great number of lateral grooves, said block can be employed for all intermediate planes, partition wall for flue gas vents etc. in the internal structure of the tile stove—substantially as illustrated in FIG. 9—as, according to the embodiment illustrated in FIG. 10, any desired arrangements can be obtained in a simple manner.

The second side face 15 of the blocks is closed and planar. When building the internal shell of a tile stove, the blocks 1 are staggered in such a manner that the closed planar side faces 15 form the external side of the internal shell so that the tiles 4 lie with their whole face on the blocks 1 without forming any air cushions or air channels. Said tiles 4 also have planar closed rear sides without ribs. For linking the tiles 4 to one another, their faces 20 being in contact with adjacent tiles may be provided with a circumferential groove 18. T-shaped connecting members are inserted into the grooves 18 of the tiles 4, the center leg of said T-shaped connecting member linking two adjacent tiles 4 and the cross bar of the connecting member linking said two adjacent tiles 4 to a tile 4 of the following row.

By means of the blocks or bricks according to this invention, the dimensions of the individual blocks required for two-shell tile stoves can be pre-calculated and bought preferably together with the tiles 4 as a construction kit. The internal shell and the internal structure can be built according to instructions without requiring any particular skill in the art as the length of the individual blocks is clearly defined by the grooves and ribs and, moreover, in case of several possibilities said length can be easily premarked.

What is claimed is:

1. A brick and the assembly for producing a double-shell tile furnace having an internal shell of refractory parallelepiped-shaped building bricks and an external shell comprising tiles of a thickness d, a length a and a height b, as well as corner tiles of the same thickness and height, one of their legs having an external length selectively of a/2 and 3a/2, one row of tiles, each, being staggered by the amount a/2, the length of building brick being selected from a brick sequence with the following relations of length: the length of the first building brick corresponds to the amount (a/2)−d, the difference in length between the two first building bricks corresponds to the amount d, and the difference in length between two building bricks, each, selectively of odd and even place value corresponds to the amount a/2, the height of said building brick being selected from a brick sequence with the following relations of height: the height of the first building brick corresponds to the amount (b/2)−d, the difference in height between the two first building bricks corresponds to the amount d, and the difference in height between two building bricks, each, selectively of odd and even place value corresponds to the amount b/2, and the wall thickness of said building brick corresponding to an amount completing the thickness d of the corner tile to the external length of one of its legs.

2. A brick and tile assembly as defined in claim 1 wherein the wall thickness of said building brick corresponds to the amount (a/2)−d.

3. A brick and tile assembly as defined in claim 2 wherein the wall thickness of said building brick corresponds to the thickness d of the tiles, such d being equal to a/4.

4. A brick and tile assembly as defined in claim 1 wherein the height of said building brick is equal to its length.

* * * * *